United States Patent [19]

Garst et al.

[11] Patent Number: 4,540,521

[45] Date of Patent: Sep. 10, 1985

[54] LIQUID QUATERNARY AMMONIUM ANTISTATIC COMPOSITIONS

[75] Inventors: Roger H. Garst, Greer; Frank N. Tuller, Simpsonville; Charles R. Tucker, Spartanburg, all of S.C.

[73] Assignee: National Distillers and Chemical Corporation, New York, N.Y.

[21] Appl. No.: 571,038

[22] Filed: Jan. 16, 1984

[51] Int. Cl.[3] ..... C07C 93/04

[52] U.S. Cl. ..... 260/459 A; 564/292; 564/294; 252/8.75; 252/8.8

[58] Field of Search ..... 564/294, 295; 260/459 A; 252/8.75, 8.8, 8.7

[56] References Cited

U.S. PATENT DOCUMENTS

| | | | |
|---|---|---|---|
| 3,113,956 | 10/1963 | Robinette | 260/459 A |
| 3,141,905 | 7/1964 | Longley | 564/292 |
| 3,517,045 | 6/1970 | Susi et al. | 260/459 A |
| 3,862,045 | 1/1975 | Sato et al. | 252/8.75 |
| 3,914,496 | 10/1975 | Jorek et al. | 260/459 A |
| 4,118,324 | 10/1978 | Steckelberk et al. | 252/8.75 |
| 4,257,769 | 3/1981 | Kleber et al. | 252/8.75 |
| 4,439,330 | 3/1984 | Ooms | 252/8.8 |

FOREIGN PATENT DOCUMENTS

| | | | |
|---|---|---|---|
| 1084134 | 9/1967 | United Kingdom | 564/294 |

*Primary Examiner*—James H. Reamer

*Attorney, Agent, or Firm*—Kenneth D. Tremain; Gerald A. Baracka

[57] ABSTRACT

This invention relates to improved liquid quaternary ammonium compositions obtained by quaternizing a mixture of amines with essentially a stoichiometric amount of a di($C_{1-4}$ alkyl)sulfate, said amine mixture containing 80 to 99.5 weight percent of an alkoxylated ether amine of the formula

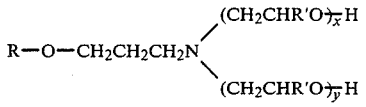

where R is an aliphatic hydrocarbon radical having from 2 to 20 carbon atoms, R′ is hydrogen or methyl and x and y are integers from 1 to 20, and 0.5 to 20 weight percent of a trialkanolamine of the formula

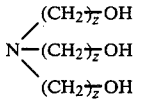

where z is an integer from 1 to 6. The quaternary ammonium compositions are useful as antistatic agents for a variety of synthetic fibers, yarns and fabrics.

11 Claims, No Drawings

LIQUID QUATERNARY AMMONIUM ANTISTATIC COMPOSITIONS

BACKGROUND OF THE INVENTION

1. Field of the Invention

This invention relates to improved liquid quaternary ammonium compositions and, more specifically, to quaternized products derived from alkoxylated ether amines and alkanolamines. The quaternary ammonium compositions are useful as antistatic agents for a variety of synthetic fibers, yarns and fabrics.

2. Description of the Invention

The need to employ finishes in various operations involved in the processing of synthetic fibers is well known. Such finishes lubricate the synthetic fiber and impart other desirable characteristics thereto. For example, finishes used in spinning or extrusion and drawing operations for the manufacture of melt-spun non-cellulosic fibers, such as nylon, polyester and polypropylene, and dry-spun non-cellulosics, such as the acrylic and modacrylic, typically contain a lubricant to modify fiber-metal friction and an antistatic agent to reduce static build-up. Emulsifiers and other additives may also be included in the finish.

Various cationic antistatic agents, including morpholinium, imidazolinium and quaternary ammonium ethosulfates, are useful for the formulation of such fiber finishes. The utility of these cationic antistatic agents is somewhat restricted, however, due to the relatively high viscosity of the resulting solutions.

H. Robinette, Jr., in U.S. Pat. No. 3,113,956 discloses quaternary trialkyl ethyl ammonium ethosulfates obtained by reacting approximately stoichiometric quantities of a long-chain trialkyl amine, such as dimethyl soya amine, and diethyl sulfate in the presence of from about 2 to 15 percent triethanolamine. While aqueous solutions prepared using the quaternary amine products of Robinette, Jr. have acceptable viscosities, the "quats" are difficult to get into solution. The quaternary trialkyl ethyl ammonium ethosulfates of Robinette, Jr. are highly viscous wax-like materials and generally require heating at 160°–170° F. with agitation for extended periods to achieve solution with water. Also, it is not possible to obtain clear pourable aqueous solutions at ambient conditions when the concentration of the Robinette, Jr. "quat" is more than about 35 percent.

It would be highly desirable, therefore, if quaternary ammonium compositions which are readily soluble in water at ambient conditions were available. It would be even more desirable if it were possible to achieve this compatibility with water without any sacrifice in the antistatic properties of the quaternary ammonium compounds. It would be still more advantageous if it were possible to obtain clear homogenous stable solutions containing as much as 50 percent or more of the quaternary ammonium product at ambient conditions and if the products were light-colored, pourable fluids.

SUMMARY OF THE INVENTION

We have now quite unexpectedly discovered novel quaternary ammonium compositions which possess all of the aforementioned desirable characteristics. The improved liquid quaternary ammonium antistatic compositions of the present invention are obtained by quaternizing a mixture of amines with essentially a stoichiometric amount of a di($C_{1-4}$ alkyl)sulfate, said amine mixture containing 80 to 99.5 weight percent of an alkoxylated ether amine of the formula

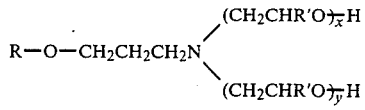

where R is an aliphatic hydrocarbon radical having from 2 to 20 carbon atoms, R′ is hydrogen or methyl and x and y are integers from 1 to 20, and 0.5 to 20 weight percent of a trialkanolamine of the formula

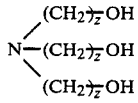

where z is an integer from 1 to 6. Quaternary ammonium compositions having especially useful antistatic properties and which are useful for the formulation of finishes for fibers, yarns and fabrics are obtained by quaternizing mixtures of triethanolamine and ethoxylated ether amines where R is an aliphatic radical having from 5 to 19 carbon atoms, R′ is hydrogen and x and y are integers such that x+y=2–10. Ethoxylated ether amines of the formula

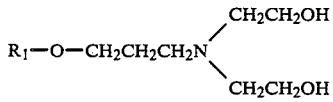

where $R_1$ is a $C_{12-18}$ alkyl group are especially advantageous, particularly when employed in an amount from 88 to 92 weight percent with 8 to 12 weight percent triethanolamine and quaternized with up to 5 mole percent excess diethylsulfate. Aqueous solutions containing up to about 50 weight percent of the abovedescribed quaternary ammonium compositions are also provided.

DETAILED DESCRIPTION

In accordance with the present invention, improved liquid quaternary ammonium antistatic compositions obtained by the quaternization of an alkoxylated ether amine/alkanolamine mixture are provided.

The alkoxylated ether amines employed for the invention are obtained by the alkoxylation of an ether amine and correspond to the general formula

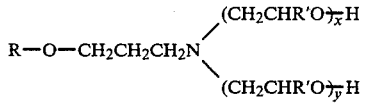

where R is an aliphatic hydrocarbon radical having from about 2 to 20 carbon atoms, R′ is hydrogen or methyl and x and y are integers from 1 to 20. In a particularly useful embodiment of this invention, R is an aliphatic radical, straight-chain or branched, having from 5 to 19 carbon atoms and x and y are integers such that x+y=2–10. Ethoxylated ether amines, i.e., R′=H, give especially advantageous results.

The alkoxylated ether amines are obtained by reacting the ether amine with ethylene oxide, propylene oxide, or mixtures thereof in accordance with conventional procedures. While the degree of alkoxylation can be varied, there should be sufficient ethylene oxide and/or propylene oxide to essentially completely react with both of the hydrogen atoms of the amine group. Ether amines of the above types which are useful for the invention are available from commercial sources, such as AZS Chemical Company, ARMAK Company and Sherex Chemical Co., Inc.

To obtain the improved liquid antistatic compositions of this invention, a trialkanolamine is necessarily present with the above-described alkoxylated ether amine during the quaternization. The trialkanolamines correspond to the general formula

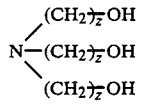

where z is an integer from 1 to 6. Triethanolamine (z=2) is especially useful in view of its commercial availability and the advantageous results obtained therewith.

The ratio of alkoxylated ether amine and trialkanolamine can be varied, however, best results are obtained when the mixture contains from 80 to 99.5 weight percent alkoxylated ether amine and 0.5 to 20 weight percent trialkanolamine. Particularly useful liquid antistats are obtained when the alkoxylated ether amine is present in an amount from 85 to 99 weight percent and the trialkanolamine is present in an amount from 1 to 15 weight percent.

The alkoxylated ether amine/trialkanolamine mixture is quaternized with an essentially stoichiometric amount of a di(lower alkyl)sulfate in accordance with known quaternization procedures. Di($C_{1-4}$ alkyl)sulfates can be employed for this purpose, however, diethyl sulfate is a particularly useful quaternizing agent in view of its ready availability and the favorable results obtained with the resulting quaternary ammonium compositions. While best results are obtained using dialkyl sulfates, other known quaternizing agents such as methyl bromide, methyl chloride, ethyl bromide, ethyl chloride and benzyl chloride may also be employed. By essentially stoichiometric is meant that a molar excess or deficiency of up to about 10 percent of the quaternizing agent is employed. In most instances, it is preferred to employ up to about 5 mole percent excess of the quaternizing agent.

Particularly useful liquid antistatic compositions are obtained by quaternizing, using an essentially stoichiometric amount of diethyl sulfate, a mixture consisting of 8 to 12 percent triethanolamine and 88 to 92 percent of an ethoxylated ether amine of the formula

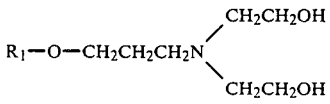

wherein $R_1$ is a $C_{12-18}$ alkyl group. The preparation of these antistatic products can be represented by the general equation

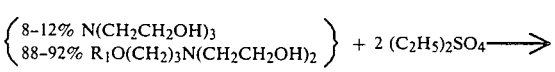

-continued

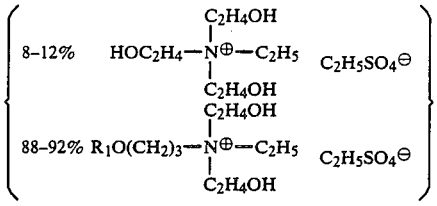

where $R_1$ is the same as defined above.

Products of the above type are relatively thin clear liquids having 25° C. kinematic viscosities in the range of 500 to 4000 centistokes. The products are readily compatible with water at concentrations up to about 50 percent by weight and aqueous solutions can be easily prepared at ambient conditions (20° C. to 25° C.) with only a few minutes agitation. The resulting aqueous solutions are typically slightly acidic with a pH in the range 5.5 to 6.9. If higher temperatures are employed to prepare the aqueous solutions, the antistatic quaternary compositions will generally "flash" into water with little or no agitation. The antistatic compositions of this invention are also compatible with other ingredients typically employed for the formulation of fiber, yarn and fabric finishes.

The above-mentioned desirable features are obtained without any sacrifice in antistatic properties. The quaternary ammonium compositions of this invention exhibit exceptional antistatic performance—equaling and most often exceeding the antistatic activity of other commonly used commercial cationic antistats. They can be used as an antistatic component in a formulated fiber lubricant or as a top additive applied to stock, yarn, fabric and carpet. They are especially advantageous in controlling static while spinning yarn on ring or open end systems. The quaternary ammonium compositions are compatible with other cationic materials and most amphoterics and nonionics and can be used to treat a variety of synthetic materials including nylon, polyester, polypropylene, acrylic and modacrylic.

Products obtained by simply blending a quaternized trialkanolamine with a quaternized alkoxylated ether amine in the same ratios as provided for do not have the same characteristics as the products of the invention obtained by quaternizing a mixture of the amine components. The resulting physical blends do not exhibit the improved fluidity obtained with the products of this invention. They are much more viscous and also lack the water compatibility necessary to provide effective antistatic agent finishes for fibers, yarns and fabrics.

The following examples more fully illustrate the various aspects of the invention discussed above and set forth the manner by which the invention can be practiced. Numerous modifications of these examples are possible and are within the scope of this invention. All parts and percentages in the examples are given on a weight basis unless otherwise indicated.

EXAMPLE I

An ethoxylated ether amine was prepared by reacting two moles ethylene oxide (EO) with one mole of an ether amine derived from mixed $C_{12-15}$ alcohols and having the formula

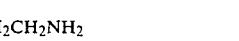

where R represents mixed $C_{12-15}$ alkyl radicals. For the reaction 1268 grams of the ether amine were charged to a stainless steel reactor with 0.8 gram 30 percent $H_3PO_2$. The reactor was sealed, a vacuum pulled on the system and the system purged several times with nitrogen while heating to 100° C. When the temperature reached 100° C., the reactor was pressurized to 15–20 psig with ethylene oxide. The reaction temperature was maintained at 95°–105° C. and additional ethylene oxide added, as required, to maintain the pressure until a total of 383 grams ethylene oxide was charged. After the final charge of ethylene oxide was essentially completely reacted, heating was terminated, the reaction mixture cooled and discharged from the reactor. The polyoxyethylene (2 EO) $C_{12-15}$ ether amine contained about 97.5 percent tertiary amine.

Four-hundred and twenty grams of the POE(2) ether amine was combined with 42 grams triethanolamine and the mixture heated to 80°–90° C. under a slow nitrogen flow. Diethylsulfate was slowly added to the amine mixture with stirring while maintaining the temperature at 80°–90° C. One-hundred and ninety-three grams diethylsulfate was added over a period of about three hours after which time the reaction mixture was stirred for two additional hours at 100° C. The resulting liquid product was comprised, on a molar basis, of about 4 parts of the ethosulfate quaternary of ethoxylated (2 EO) $C_{12-15}$ ether amine and 1 part ethosulfate quaternary of triethanolamine. The coquaternized product had the following properties:

| | |
|---|---|
| Acid Value | 29.0 |
| Amine Value | 9.7 |
| pH (5% Solution) | 6.0 |
| Smoke Point | 245° F. |
| Flash Point | 390° F. |
| Fire Point | 395° F. |
| Viscosity: 25° C. | 3262 cSt |
| 50° C. | 597 cSt |

To demonstrate the utility of the above prepared coquaternized ether amine/triethanolamine product as an antistat, samples were prepared by diluting with water to obtain 35 percent active solutions. The solutions were in turn diluted with isopropanol and applied to polyester yarn (150 denier/36 filament) using an Atlab Finish Applicator. All test yarns were scoured with isopropanol to remove any residual spin finish or processing lubricant prior to application of the antistat. After application, the yarns were brought to equilibrium moisture content by conditioning for a minimum of twenty-four hours at 70±3° F. and 50±2% relative humidity before testing. The treated yarns were then evaluated in a static test whereby one or more strands of the yarn was clamped to the input and output terminals of an electrode and a charge of 100 volts applied to the input terminal. The two terminals were spaced 10 centimeters apart. The time (in seconds) required for half the voltage (50 volts) to be discharged through the yarn was measured and reported as the resistivity half life. The testing was carried out in a conditioning room where the temperature and humidity were controlled at 70° F. and 50%, respectively. Resistivity half life (average of several determinations) obtained for yarns treated with the coquaternized ether amine/triethanolamine were as follows:

| | |
|---|---|
| One-Strand: | |
| 0.5% o.w.f. | 0.7 seconds |
| 0.1% o.w.f. | 2.3 seconds |
| 0.05% o.w.f. | 3.0 seconds |
| Two-Strands: | |
| 0.1% o.w.f. | 1.0 seconds |
| 0.05% o.w.f. | 1.7 seconds |
| Four-Strands: | |
| 0.05% o.w.f. | 1.0 seconds |
| Control (Untreated): | |
| One-Strand | >300 seconds |
| Two-Strands | >300 seconds |
| Four-Strands | >300 seconds |

The treated yarns were stored for one month and retested with the following results:

| | |
|---|---|
| One-Strand: | |
| 0.5% o.w.f. | 0.8 seconds |
| 0.1% o.w.f. | 1.4 seconds |
| 0.05% o.w.f. | 3.6 seconds |
| Two-Strands: | |
| 0.1% o.w.f. | 0.9 seconds |
| 0.05% o.w.f. | 1.6 seconds |
| Four-Strands: | |
| 0.05% o.w.f. | 0.8 seconds |

EXAMPLE II

To demonstrate the superiority of the coquaternized compositions of this invention, the ethoxylated ether amine of Example I was quaternized with diethylsulfate except that for this experiment the triethanolamine was omitted. For the quaternization, 800 grams of the POE(2) $C_{12-15}$ ether amine was charged to a reactor and heated to 60° C. under nitrogen. Diethylsulfate (302 grams) was then added over a 15 minute period while maintaining the temperature at 60°–80° C. When the addition was complete the mixture was stirred for one hour at 80° C. The resulting ethosulfate quaternary of the ethoxylated (2 EO) $C_{12-15}$ ether amine was a pasty gel.

Thirty-five percent active aqueous solutions were prepared using the above-prepared product and the product of Example I. To prepare the solutions, the active ingredient and the water were separately heated to 65° C. and then combined with moderate agitation. The product of Example I immediately "flashed" into the water when they were combined to provide a clear homogeneous solution, whereas a gel formed with the product prepared above. It was necessary to stir the solution for an additional 83 seconds while heating at 65° C. in order to dissolve the gel. Furthermore, when 50 percent active solutions were prepared and when the solutions were allowed to stand overnight at room temperature, the 50 percent solution obtained using the above-prepared product gelled. The 50 percent solution prepared using the coquaternized product of Example I remained clear and fluid.

EXAMPLE III

To demonstrate the versatility of the invention and the ability to obtain useful coquaternized products from propoxylated ether amines, 825 grams ether amine (SURFAM ® P86M) was reacted with 365 grams propylene oxide and 200.3 grams of the resulting propoxylated ether amine combined with 20.9 grams triethanolamine and the mixture quaternized using 86.0 grams diethylsulfate. the propoxylation and quaternization were carried out following the procedure described in Example I. Physical properties of the coquaternized product and test results obtained with polyester yarn treated therewith were as follows:

| | |
|---|---|
| Acid Value | 50.0 |
| Amine Value | 14.0 |
| pH (5% Solution) | 5.9 |
| Smoke Point | 215° F. |
| Flash Point | 380° F. |
| Fire Point | 385° F. |
| Viscosity: 25° C. | 2583 cSt |
| 50° C. | 461 cSt |

Resistivity Half Life:

| | |
|---|---|
| One-Strand: | |
| 0.5% o.w.f. | 1.3 seconds |
| 0.1% o.w.f. | 5.1 seconds |
| 0.05% o.w.f. | 9.1 seconds |
| Two-Strands: | |
| 0.1% o.w.f. | 2.5 seconds |
| 0.05% o.w.f. | 4.4 seconds |
| Four-Strands: | |
| 0.1% o.w.f. | 1.3 seconds |
| 0.05% o.w.f. | 2.3 seconds |

EXAMPLE IV

To demonstrate the ability to obtain higher ethoxylated products, four moles ether amine (SURFAM® P86M) was reacted with 40 moles ethylene oxide at 95°-105° C. in accordance with the general procedure previously described. A small amount of $H_3PO_2$ was employed as catalyst for the condensation. When the ethoxylation was complete, the mixture was cooled to 80° C. and 1.92 moles triethanolamine added under a nitrogen atmosphere. The mixture was stirred for 15 minutes, evacuated and 5.88 moles diethylsulfate slowly introduced while maintaining the temperature at 80°-100° C. When quaternization was complete, the product was cooled and discharged. The resulting viscous liquid product, comprised approximately of four parts ethosulfate quaternary of polyoxyethylene (10 EO) ether amine and one part ethosulfate quaternary of triethanolamine had an amine value of 1.51, pH (5% solution) of 6.6 and viscosity (25° C.) of 825 centistokes and was an effective antistatic agent for the treatment of polyester, nylon and polyolefin fibers and filaments.

EXAMPLE V

A mixture of primary ether amines of the general formula $CH_3(CH_2)_xOCH_2CH_2CH_2NH_2$ wherein approximately 60 percent of the amines have x=13 with the remainder of the amines having x=11 was reacted with 2 moles ethylene oxide per mole ether amine. For the ethoxylation 962.5 grams of the ether amine was charged to a reactor and, after purging and heating to 100° C., the reactor was pressured (15-25 psig) with ethylene oxide. A total of 308 grams ethylene oxide was charged while maintaining the temperature at about 95°-105° C. When essentially all of the ethylene oxide was reacted the reaction mixture was cooled and discharged.

Two-hundred thirty grams of the ethoxylated ether amine was combined with 30 grams triethanolamine and the mixture heated to 80°-90° C. Diethylsulfate was then slowly added with stirring while maintaining the temperature until a total of 106 grams had been added. When the addition was complete, the mixture was stirred for two hours at 100° C. The resulting coquaternized product had the following properties:

| | |
|---|---|
| Acid Value | 28.4 |
| Amine Value | 16.5 |
| pH (5% Solution) | 6.6 |
| Smoke Point | 200° F. |
| Flash Point | 375° F. |
| Fire Point | 395° F. |
| Viscosity: 25° C. | 2442 cSt |
| 50° C. | 477 cSt |

Resistivity half life for polyester yarn treated with various levels of the coquaternized product and a commercially availiable antistatic agent were determined in accordance with the previously described test procedure. The commercial antistat used was a dimethyl soya amine/triethanolamine diethylsulfate antistatic agent of the type described in U.S. Pat. No. 3,113,956. Results were as follows:

| | Resistivity Half Life | |
|---|---|---|
| | Co-quaternary | Commercial Antistat |
| One-Strand: | | |
| 0.5% o.w.f. | 0.7 | 0.6 |
| 0.1% o.w.f. | 1.9 | 1.6 |
| 0.05% o.w.f. | 3.9 | 3.2 |
| Two-Strands: | | |
| 0.1% o.w.f. | 0.8 | 0.9 |
| 0.05% o.w.f. | 1.8 | 1.9 |
| Four-Strands | | |
| 0.05% o.w.f. | 0.8 | 1.0 |

It is evident from the above data that the antistatic activity of the coquaternized product prepared in accordance with this invention is comparable to that obtained with the commercial antistat. However, the products of this invention have significantly improved solubility. The coquaternized ether amine/triethanolamine product was readily soluble in water at room temperature and stable homogeneous aqueous solutions were obtained at all concentrations. The aqueous solutions prepared with the products of this invention had excellent shelf stability and remained homogeneous with no evidence of gel formation when stored for prolonged periods under ambient conditions. On the other hand, the commercial antistat was very difficulty soluble. Typically, when the commercial antistat is combined with the water a tight gel is formed which clings to the stirrer and is difficult to dissolve. It was necessary to heat the solutions containing the commercial antistat for seven hours at 65° C. in order to obtain a clear homogeneous 35 percent aqueous solution. It is even more difficult to achieve solution when higher concentrations of the antistats of U.S. Pat. No. 3,113,956 are employed.

To further demonstrate the utility of the improved products of this invention, polyester yarn treated with various levels of the above-prepared coquaternized product were evaluated for antistatic activity using a dynamic test method. The procedure utilized a Rothschild F-Meter in conjunction with a Rothschild Static Volt-Meter and measured the amount of static charge buildup (in volts) as a single strand of yarn was moved at a constant rate over a metal pin. For this well known and widely used test procedure, the static charge was measured and discharged at fixed time intervals. Conditions and equipment settings for the test were: Relative humidity 48%; Temperature 68° F.; Incoming tension ($T_2$) 10 g; Contact angle ($\theta$) 180° on a polished chrome pin; Voltage measured at twelve second intervals at yarn speeds of 100, 200 and 300 meters/minute.

| 12 Second Voltage Build-Up (Volts) vs. Yarn Speed (Meters/Minute) | | | |
|---|---|---|---|
| | 100 M/Min. | 200 M/Min. | 300 M/Min. |
| 0.5% o.w.f. | 2.7 Volts | — | — |
| 0.1% o.w.f. | 7.9 Volts | 3.2 Volts | 2.8 Volts |
| 0.05% o.w.f. | 7.4 Volts | 71.5 Volts | 287 Volts |

Values reported are the average of at least three readings.

We claim:

1. An improved liquid quaternary ammonium antistatic composition obtained by quaternizing a mixture of amines consisting of 80 to 99.5 weight percent (a) alkoxylated ether amine of the formula

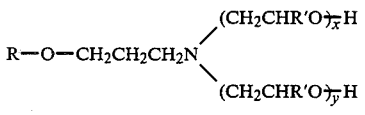

where R is an aliphatic hydrocarbon radical having from 2 to 20 carbon atoms, R′ is hydrogen or methyl and x and y are integers from 1 to 20, and 0.5 to 20 weight percent (b) trialkanolamine of the formula

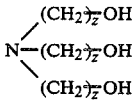

where z is an integer from 1 to 6, with an essentially stoichiometric amount of a di($C_{1-4}$ alkyl)sulfate.

2. The quaternary ammonium composition of claim 1 further characterized as having a 25° C. kinematic viscosity in the range 500 to 4000 centistokes.

3. The quaternary ammonium composition of claim 1 wherein the trialkanolamine (b) is triethanolamine.

4. The quaternary ammonium composition of claim 3 wherein for the alkoxylated ether amine (a) R is an aliphatic radical having from 5 to 19 carbon atoms and x and y are integers such that $x+y=2-10$.

5. The quaternary ammonium composition of claim 4 wherein (b) is present in an amount from 1 to 15 weight percent and (a) is an ethoxylated ether amine present in an amount from 85 to 99 weight percent.

6. The quaternary ammonium composition of claim 5 which is quaternized with diethyl sulfate.

7. The quaternary ammonium composition of claim 6 wherein (a) is an ethoxylated ether amine of the formula

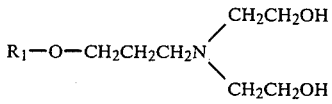

where $R_1$ is a $C_{12-18}$ alkyl group, said ether amine present in an amount from 88 to 92 weight percent, and (b) is present in an amount from 8 to 12 weight percent.

8. The quaternary ammonium composition of claim 7 wherein up to about 5 mole percent excess diethyl sulfate is employed for the quaternization.

9. An aqueous solution containing a quaternary ammonium composition obtained by quaternizing a mixture of amines with an essentially stoichiometric amount of a di($C_{1-4}$ alkyl)sulfate, said amine mixture containing 80 to 99.5 weight percent alkoxylated ether amine of the formula

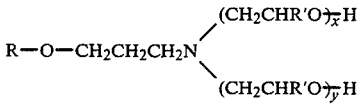

where R is an aliphatic hydrocarbon radical having from 2 to 20 carbon atoms, R′ is hydrogen or methyl and x and y are integers from 1 to 20 and 0.5 to 20 weight percent trialkanolamine of the formula

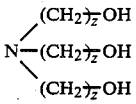

where z is an integer from 1 to 6.

10. The aqueous solution of claim 9 having a pH of 5.5 to 6.9.

11. The aqueous solution of claim 10 wherein the quaternary ammonium composition is quaternized with up to 5 mole percent excess diethyl sulfate and the amine mixture consists of 85 to 99 weight percent ethoxylated ether amine of the formula

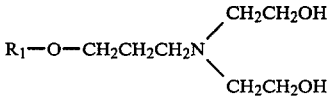

where $R_1$ is a $C_{12-18}$ alkyl group and 1 to 15 weight percent triethanolamine.

* * * * *